United States Patent [19]

Biddle

[11] 4,399,938

[45] Aug. 23, 1983

[54] TACKER

[75] Inventor: Howard W. Biddle, Histon, England

[73] Assignee: Ofrex Group Limited, London, England

[21] Appl. No.: 197,012

[22] Filed: Oct. 14, 1980

[30] Foreign Application Priority Data

Oct. 15, 1979 [GB] United Kingdom ..... 7935721

[51] Int. Cl.[3] ..... B25C 5/06

[52] U.S. Cl. ..... 227/132; 227/120; 30/179

[58] Field of Search ..... 227/8, 132, 120, 19, 227/DIG. 1; 30/175, 176, 177, 178, 179, 188, 193, 273, 296, 298

[56] References Cited

U.S. PATENT DOCUMENTS

| | | | |
|---|---|---|---|
| 146,345 | 1/1874 | Leach | 30/179 |
| 213,758 | 4/1879 | Kellar | 30/179 |
| 1,028,778 | 6/1912 | Powers et al. | 227/132 |
| 3,231,976 | 2/1966 | Wallshein | 227/DIG. 1 |
| 3,467,294 | 9/1969 | Fisher | 227/8 X |
| 3,987,951 | 10/1976 | Thornhill | 227/120 |
| 4,109,844 | 8/1978 | Becht | 227/120 |
| 4,126,260 | 11/1978 | Mickelsson | 227/132 |
| 4,156,499 | 5/1979 | Frank | 227/132 |

*Primary Examiner*—Paul A. Bell

*Attorney, Agent, or Firm*—Mason, Fenwick & Lawrence

[57] ABSTRACT

A tacker has a magazine to contain staples and a striker movable against a spring biassed to eject the staples from an ejection slot. An integral handle and pawl are provided to engage the striker to move the striker against the spring bias, the pawl being disengageable from the striker to release the striker to enable a staple to be ejected. The arrangement is such that the handle and part of the magazine are spaced apart by such a distance that the handle and the magazine can be grasped by a single hand. The handle, on operation of the device, moving towards the magazine.

7 Claims, 7 Drawing Figures

TACKER

FIELD OF THE INVENTION

The present invention relates to a tacker and more particularly to a tacker adapted to eject staples.

BACKGROUND OF THE INVENTION

Tackers have been provided previously, such tackers comprising relatively complex arrangements constituting a magazine located at the bottom of apparatus, a handle of arch-type configuration mounted above the magazine, the handle providing a hand grip so that the fingers of the user embrace the handle, (the entire band of the user thus being mounted over the magazine) an operating lever which may be grasped by an operator simultaneously with grasping of the handle, and a spring loaded striker mechanism actuated by the handle and adapted to drive staples or the like from the magazine through an ejection slot located at one end of the magazine. In using such a device the lower surface of the magazine, which is flush with the mouth of the ejection slot, is located in contact with an item to be tacked, and the handle is operated for staples or tacks to be ejected from the ejection slot to become embedded in the surface adjacent the ejection slot.

Such tackers are relatively bulky, and utilise a considerable quantity of raw material in their construction. Also substantially the entire tacker must be placed in contact with the surface of an item to be tacked, and thus tacks cannot be inserted into inaccessible locations. Also, where the surface to be tacked is to be compressed before takcing e.g. when a carpet is to be tacked or upholstery is to be tacked, a great force must be applied to the tacker.

OBJECT OF THE INVENTION

The present invention seeks to provide a tacker which is simple and yet which is versatile and which is thus cheaper to manufacture than prior proposed tackers and which obviates some of the disadvantages of prior tackers.

SUMMARY OF THE INVENTION

According to the broadest aspect of this invention there is provided a tacker comprising a magazine adapted to contain staples or the like, means defining an ejection slot adjacent one end of the magazine, means to bias staples within the magazine to said one end thereof, a striker movable within said ejection slot to eject staples, spring means for biassing said striker to a staple ejecting position and an integral handle and pawl adapted to engage said striker and move said striker against said spring bias, said pawl being subsequently disengageable from the striker to release the striker, the arrangement being such that the handle and part of the magazine are spaced apart by such a distance to enable the handle and the magazine to be grasped by a single hand, the handle, on operation of the device, moving towards the magazine.

Preferably the ejection slot protrudes beyond the level of the lower part of the magazine, the ejection slot being defined by a guide member.

Preferably the means for biassing said striker comprise a leaf spring, the leaf spring being fixedly mounted in position adjacent the end of the magazine remote from the ejection slot and the free end of the leaf spring engaging a slot or aperture formed in the striker.

Preferably a housing member is provided mounted on the magazine and supporting a pivot pin, the handle and pawl being pivotally mounted on said pivot pin there being an oval aperture in said handle and pawl which accommodates said pivot pin.

Preferably a protrusion is provided on the handle in the region of the pivot pin adapted to engage a stop formed on said housing so that when the striker has been elevated fully by depressing the handle the protrusion will engage the stop causing the handle and pawl to move axially relative to said pivot pin by virtue of the oval aperture thus disengaging the pawl from the striker permitting the striker to be released to eject a staple.

Conveniently a pivotally mounted foot is provided at the end of the magazine remote from the ejection slot, the foot being pivotally movable to a position in which it traps the handle in the fully depressed position.

Preferably the magazine is formed of an aluminium extrusion having, at the end thereof adjacent the guide slot, a plate of hard material to act as a guide plate for tacks or staples ejected from the apparatus.

BRIEF INTRODUCTION TO THE DRAWINGS

In order that the invention may be more readily understood, and so that further features thereof may be appreciated the invention will now be described by way of example with reference to the accompanying drawings in which.

DESCRIPTION OF A PREFERRED EMBODIMENT

Figure 1:
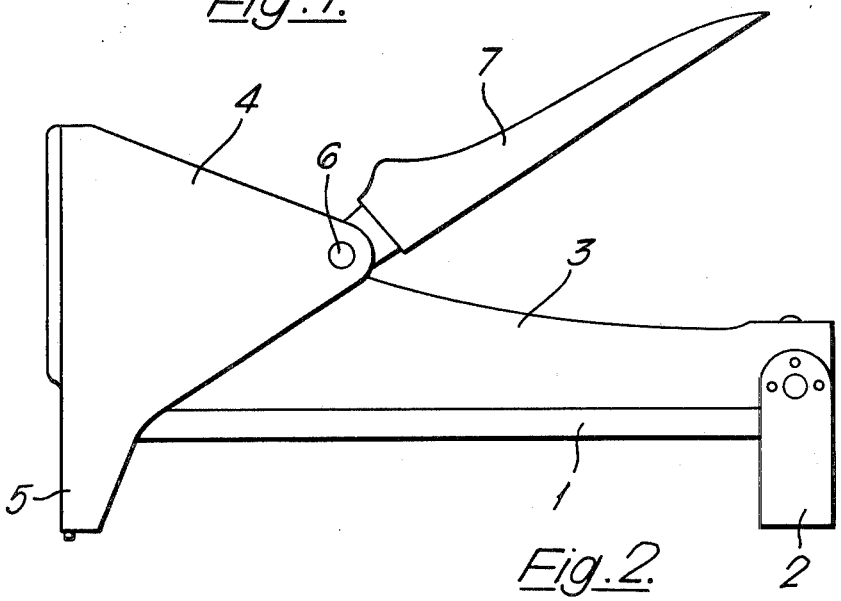
FIG. 1 is a side view of one embodiment of an apparatus in accordance with the invention in one position.
Figure 2:
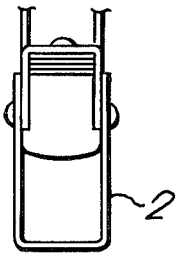
FIG. 2 is an end elevational view of part of the apparatus of FIG. 1.
Figure 3:
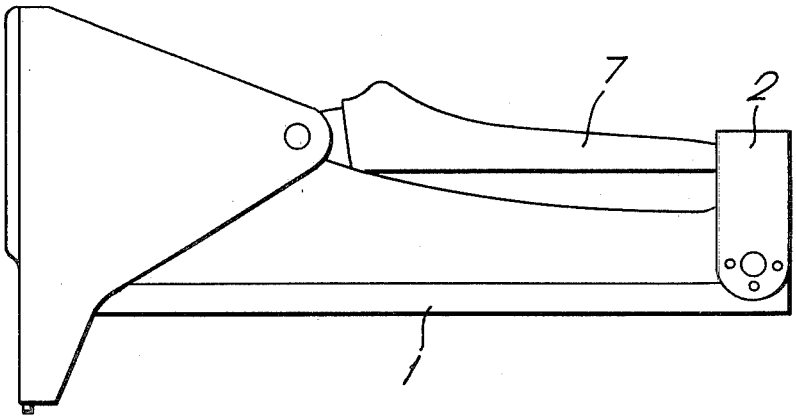
FIG. 3 is a side view showing the apparatus in a second condition.

Referring now to the drawings a tacker in accordance with the invention comprises a magazine 1. At one end of the magazine there is a pivotal foot 2 which is movable from the position illustrated in FIG. 1 in which the foot protrudes below the magazine 1 to a position illustrated in FIG. 3 in which the fott 2 is located above the magazine. Mounted above the magazine 1 is a first housing part 3 and mounted at the forward end of the magazine 1 and above the magazine 1 is a second housing part 4, this second housing part 4 defining an ejection slot in the region 5. A pivot pin 6 is connected to the housing part 4 and a handle 7 is pivotally mounted on the pin 6.

When the handle is depressed a staple from the magazine is ejected through the ejection slot 5. When the tacker is not in use the handle 7 may be retained in a retracted position by depressing the handle and subsequently rotating the foot 2 to the position illustrated in FIG. 3.

Figure 4:
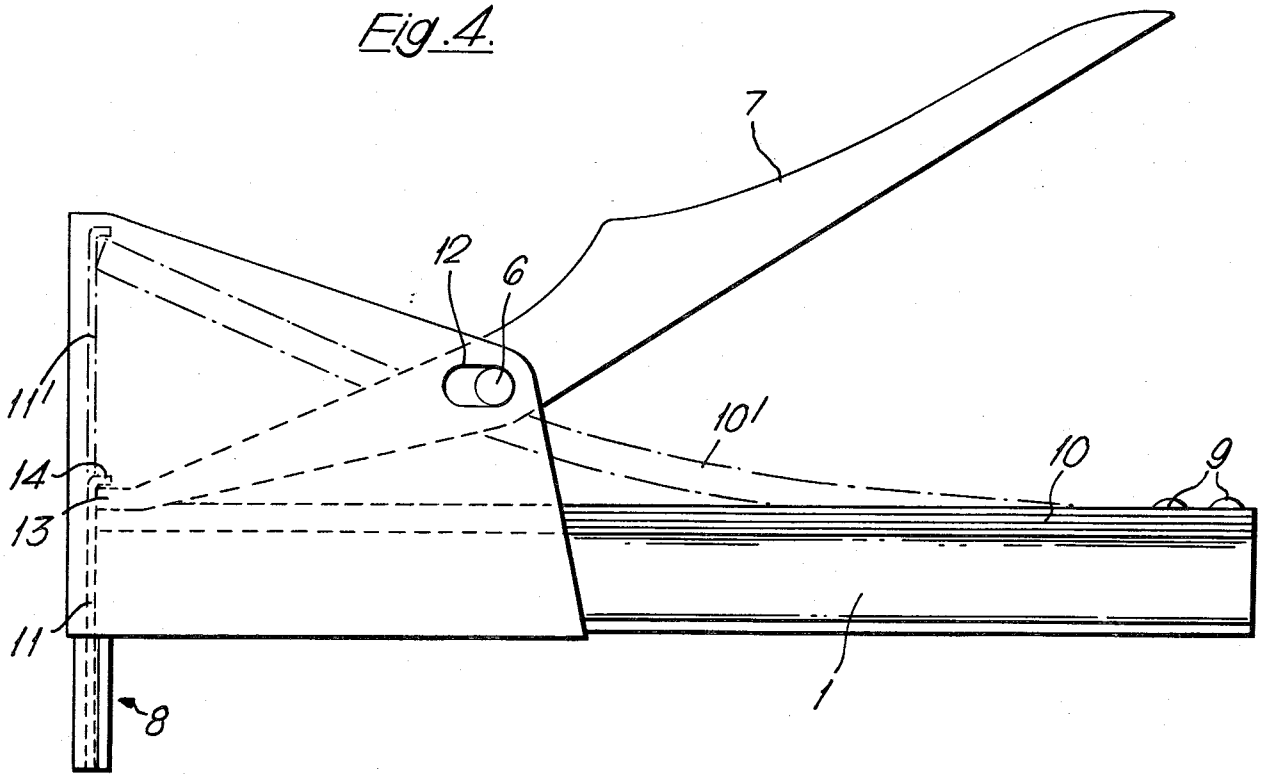
FIG. 4 is a diagrammatic view for explaining the operation of the device.

Turning now to FIG. 4 of the accompanying drawings the magazine 1 can be observed, the magazine terminating in a downwardly directed guide slot 8 which is formed by part of the apparatus. Securely mounted on the top of the magazine 1, as by studs 9 is a leaf spring assembly 10. The leaf spring engages an aperture formed in a striker 11. The striker is slidable through the ejection slot 8. The handle 7 is pivotally mounted on the pin 6 by virtue of an oval slot 12 formed in the handle 7. The forward end 13 of the handle engages a lug 14 that is formed on the striker. In operation of the device the handle 7 is depressed, thus causing the striker to rise, to the position 11', the spring 10 then being in position 10'. As the striker rises so a staple in the magazine 1 is urged forwardly into the ejection slot by means of a biassing spring present within the magazine. Also as the striker 11 rises the spring 10 is placed under tension. When the striker reaches its uppermost point the handle 7 moves relatively to the pin 6 by virtue of the oval slot 12 thus disengaging the forward end 13 of the handle from the lug 14. The striker thus moves rapidly downwardly under the influence of the biassing spring 10, thus forceably ejecting a staple through the guide slot 8. It will be appreciated that a person utilising such a device will grasp the handle and the magazine in one hand and the compressive force of the hand will be applied to the underside of the magazine and to the upper side of the handle. Since the staples are ejected through an ejection slot that protrudes beyond the lower level of the magazine it is quite practicable to grasp the magazine in this way. Also the protruding ejection slot may be used to apply a considerable force to a surface to be tacked before a staple is released.

It will be appreciated that this embodiment of the invention has very few moving parts and is relatively simple and is therefore economic to manufacture. Also the device is light is very maneouverable and is easy to use.

Figure 5:
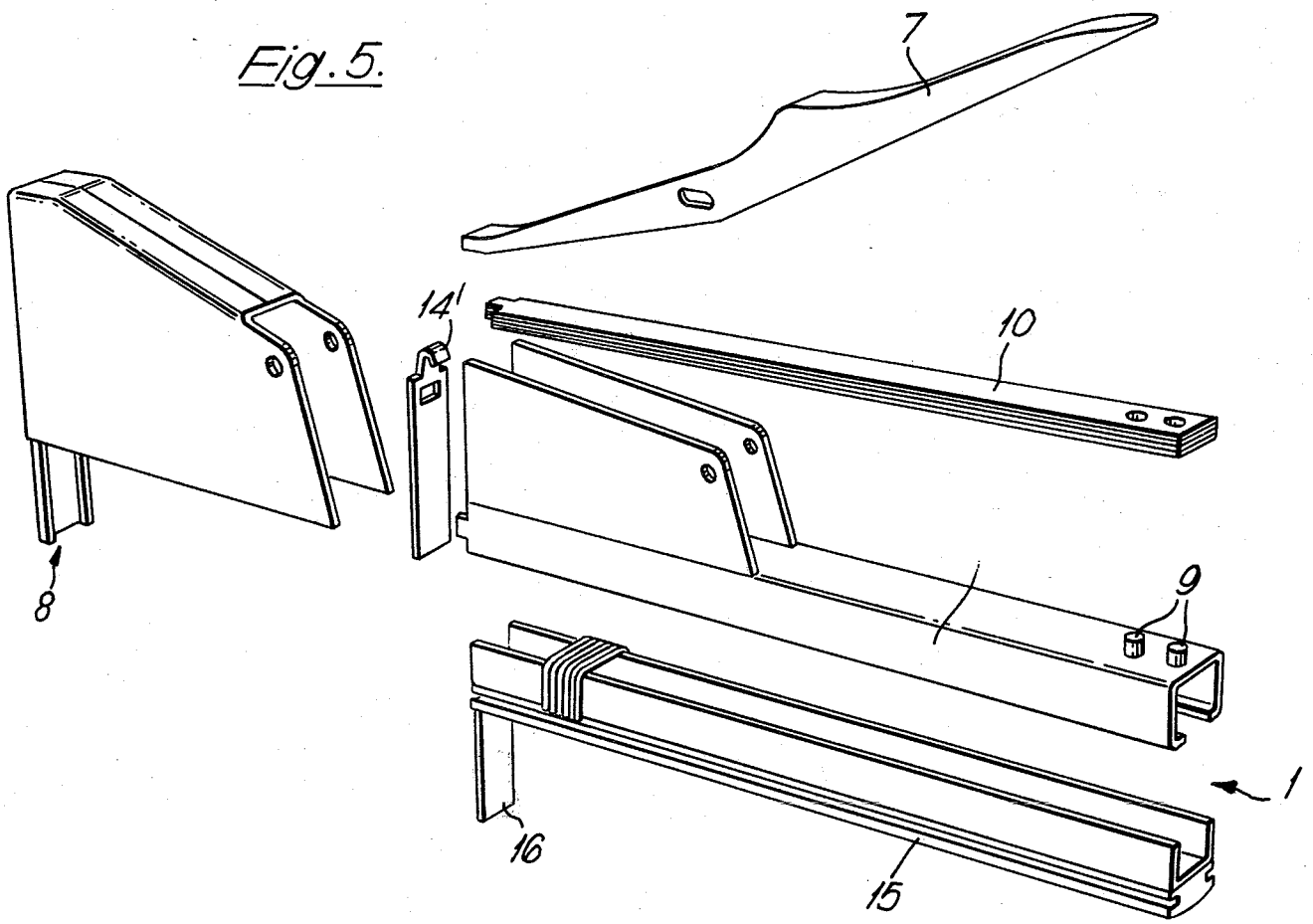
FIG. 5 is an exploded view of the apparatus shown in FIG. 4.

FIG. 5 illustrates the simplicity of this described embodiment, since this figure comprises an exploded view of the apparatus. This figure shows that the magazine 1 is formed of two co-operating parts 14, 15, the lower part 15 having a downwardly depending plate 16 at the front end thereof which forms part of the means defining the ejection slot 8.

Figure 6:
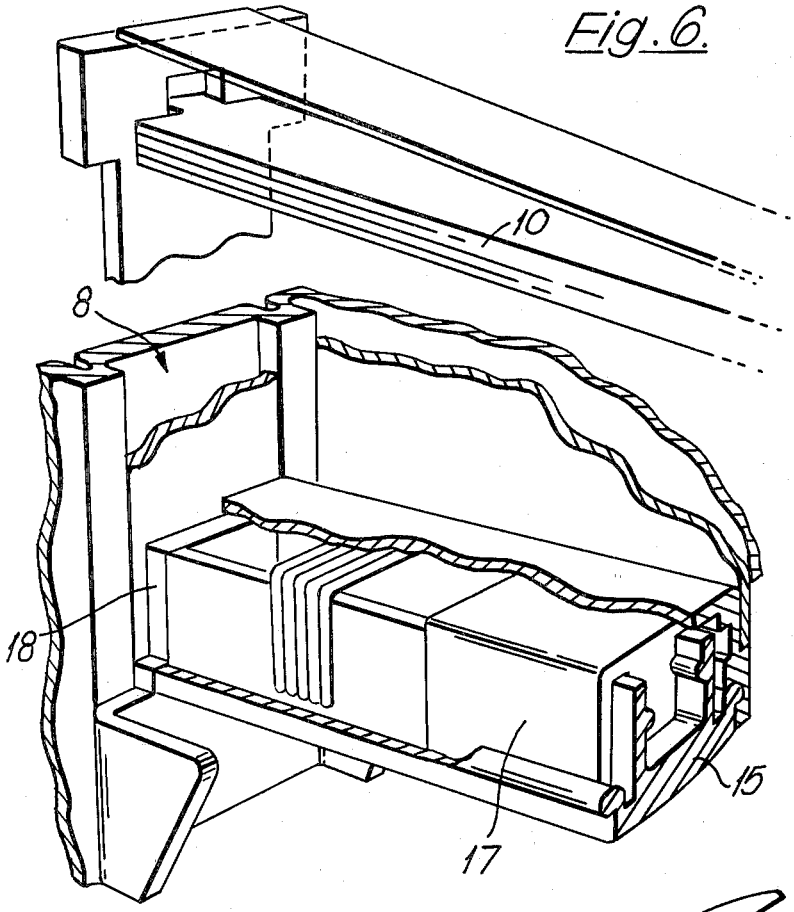
FIG. 6 is an exploded front view with parts thereof cut away of an alternative preferred embodiment of the invention and FIG. 7 is a side view with parts thereof cut away of a preferred embodiment of the invention.

FIG. 6 illustrates a preferred type of magazine in which the lower part of the magazine 15 is formed as an aluminium extrusion, the aluminium extrusion defining a channel adapted to accept substantially "U" sectioned staples and also defining means for guiding a pusher member 17 along the channel under the influence of a spring (not shown) to push the staples towards the ejection slot 8. At the forward end the aluminium extrusion is provided with a plate of hardened steel 18 or some similar hard material resistant to wear since this plate will form part of the means defining the ejection slot 8 and will thus be subjected to wear since staples and the striker will pass and re-pass this particular component. In this particular embodiment the leaf spring 10 comprises two separate parts as can be clearly seen.

Figure 7:
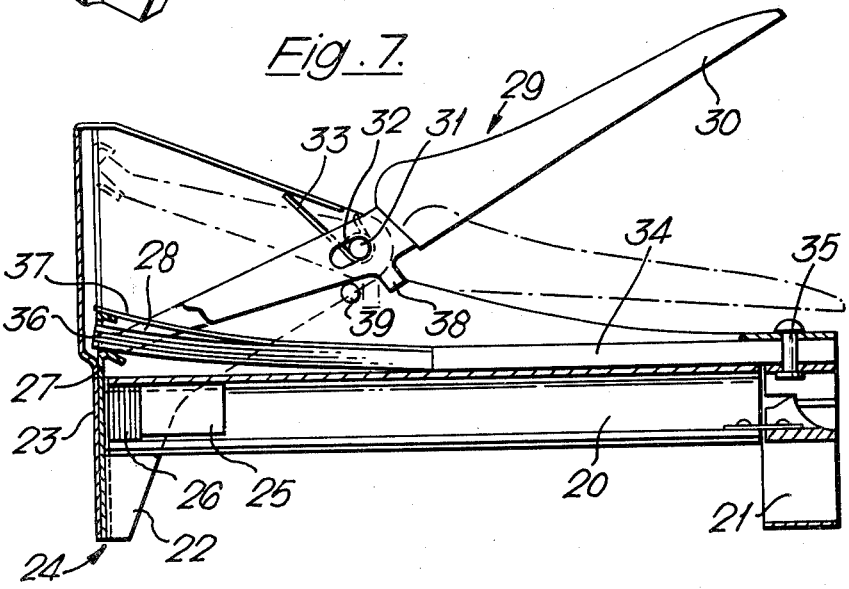

FIG. 7 illustrates a preferred embodiment of the invention. In this embodiment a magazine 20 is provided with a pivotally mounted foot 21 at one end thereof and, at the forward end thereof is provided with depending means 22 which, together with a housing member 23 forms an ejection slot having an open lower mouth 24. The member 23 also defines a housing that covers the front upper part of the machine. This housing member is shown cut away in the drawing for purposes of clarity. The magazine contains a pusher member 25 which is biassed by means of a spring to force staples 26 into the ejection slot 24. A striker 27 is provided which is engaged by a pawl 28 which forms part of an integral pawl and handle assembly 29, which includes a handle 30 which protrudes above the rear part of the magazine provided with the foot 21. The handle is pivotally mounted on a pin 31 by means of an oval slot 32. A spring 33 is provided to bias the handle to the position illustrated in the drawings. A leaf spring 34 is provided, the leaf spring being secured by means of a rivet 35 to the rear end of the magazine 2, the forward end of the spring 36 passing through an aperture formed in the striker. A supplementary spring 37 may be provided if desired. The integral handle and pawl assembly 29 includes a protrusion 38 which is adapted to co-operate with a stop 39 forming part of the housing member 23.

In operation of the device the handle is initially depressed, causing the pawl 28 to raise the striker 27 thus placing the leaf spring 34 under tension. As the lower end of the striker moves past the magazine the pusher 25 moves forwardly under the biassing effect of the spring thus pushing a staple 26 into the ejection slot. As the handle 30 is fully depressed the protrusion 38 engages the stop 39 and subsequent pressure applied to the handle causes the handle to move against the bias of the spring 33 with the handle moving by virtue of the shape of the oval aperture 32 surrounds the pin 31. Thus the pawl 28 becomes disengaged from the striker and the striker then moves downwardly under the force applied by the spring 34 to eject a staple from the magazine.

What I claim is:

1. A stapler capable of applying staples perpendicularly to interior portions of large flat areas, said stapler comprising a magazine, a quantity of staples mounted in said magazine so as to be individually ejected therefrom, means defining an ejection slot adjacent one end of the magazine, means to bias said staples within the magazine to said one end thereof, a striker movable within said ejection slot to eject said staples, spring means for biassing said striker to a staple ejecting position and an integral handle and pawl adapted to engage said striker and move said striker against said spring bias, said pawl being subsequently disengageable from the striker to release the striker, the arrangement being such that the handle and part of the magazine are spaced apart by such a distance to enable the handle and the magazine to be grasped by a single hand so that the user's fingers extend beneath the magazine, the handle, on operation of the device, moving towards the magazine and wherein said ejection slot extends downwardly, and guide means communicating with said ejection slot and extending downwardly from said magazine opposite said handle a distance equal to or greater than the thickness of a user's fingers extending about the lower surface of said magazine for guiding individual staples ejected from the magazine by the striker.

2. A stapler according to claim 1 wherein the means for biassing said striker comprise a leaf spring, the leaf spring being fixedly mounted in position adjacent the end of the magazine remote from the ejection slot and the free end of the leaf spring engaging engagement means formed in the striker.

3. A stapler according to claim 1 wherein a housing member is provided mounted on the magazine and supporting a pivot pin, the handle and pawl being pivotally mounted on said pivot pin there being an oval aperture in said handle and pawl which accommodates said pivot pin.

4. A stapler according to claim 3 wherein a protrusion is provided on the handle in the region of the pivot pin adapted to engage a stop formed on said housing so that when the striker has been elevated fully by depressing the handle the protrusion will engage the stop causing the handle and pawl to move axially relative to said pivot pin by virtue of the oval aperture thus disengaging the pawl from the striker permitting the striker to be released to eject a staple.

5. A stapler according to claim 1 wherein a pivotally mounted foot is provided at the end of the magazine remote from the ejection slot, the foot being pivotally movable to a position in which it traps the handle in the fully depressed position and to a second position extending downwardly from the magazine parallel to said guide means.

6. A stapler according to claim 1 wherein the magazine is formed of an aluminium extrusion having, at the end thereof adjacent the guide slot, a plate of hard material to act as a guide plate for items ejected from the apparatus.

7. A stapler according to claim 1 further including foot means spaced from said guide means and extending downwardly from said magazine the same distance as said guide means so that said guide means and said foot means can cooperate to hold said magazine in spaced parallel relation from a surface to be stapled.

* * * * *